US009689062B2

(12) United States Patent
Mori et al.

(10) Patent No.: US 9,689,062 B2
(45) Date of Patent: Jun. 27, 2017

(54) RESOURCE SAVING-TYPE TITANIUM ALLOY MEMBER POSSESSING IMPROVED STRENGTH AND TOUGHNESS AND METHOD FOR MANUFACTURING THE SAME

(71) Applicant: NIPPON STEEL & SUMITOMO METAL CORPORATION, Tokyo (JP)

(72) Inventors: Kenichi Mori, Tokyo (JP); Hideki Fujii, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 240 days.

(21) Appl. No.: 14/408,530

(22) PCT Filed: Aug. 14, 2013

(86) PCT No.: PCT/JP2013/071941
§ 371 (c)(1),
(2) Date: Dec. 16, 2014

(87) PCT Pub. No.: WO2014/027677
PCT Pub. Date: Feb. 20, 2014

(65) Prior Publication Data

US 2015/0191812 A1 Jul. 9, 2015

(30) Foreign Application Priority Data

Aug. 15, 2012 (JP) ..... 2012-180124

(51) Int. Cl.
*C22F 1/18* (2006.01)
*C22C 14/00* (2006.01)
*C22F 1/00* (2006.01)

(52) U.S. Cl.
CPC ..... *C22F 1/183* (2013.01); *C22C 14/00* (2013.01); *C22F 1/002* (2013.01); *C22F 1/18* (2013.01)

(58) Field of Classification Search
CPC .. C22C 14/00; C22F 1/002; C22F 1/18; C22F 1/183
See application file for complete search history.

(56) References Cited

U.S. PATENT DOCUMENTS 5,219,521 A 6/1993 Adams et al.
5,342,458 A * 8/1994 Adams ..... C22C 14/00 148/421

(Continued)

FOREIGN PATENT DOCUMENTS

CN 103348029 A 10/2013
EP 2674506 A1 12/2013

(Continued)

OTHER PUBLICATIONS

Chinese Office Action and Search Report dated Dec. 21, 2015, for Chinese Application No. 201380043463.X with the English translation of the Office Action.

(Continued)

*Primary Examiner* — Jessee Roe
*Assistant Examiner* — Nicholas Wang
(74) *Attorney, Agent, or Firm* — Birch, Stewart, Kolasch & Birch, LLP

(57) ABSTRACT

"To provide, at low cost, a resource saving-type titanium alloy that uses alloy elements more abundant in resources and more inexpensively available compared to conventional titanium alloys, and, when added even in a smaller amount than the conventional alloys, can simultaneously realize both high strength and high toughness. Provided is a titanium alloy member having excellent strength and toughness, (Continued)

consisting of, in mass %, Al: more than or equal to 4.5% and less than 5.5%, Fe: more than or equal to 1.3% and less than 2.3%, Si: more than or equal to 0.25% and less than 0.50%, O: more than or equal to 0.05% and less than 0.25%, and the balance: titanium and unavoidable impurities. The titanium alloy member has a microscopic structure that is an acicular structure having an acicular $\alpha$ phase with a mean width of less than 5 pm."

4 Claims, 2 Drawing Sheets

(56) References Cited

U.S. PATENT DOCUMENTS

| | | | | |
|---|---|---|---|---|
| 6,228,189 | B1 * | 5/2001 | Oyama | C22F 1/183 148/421 |
| 2003/0211003 | A1 | 11/2003 | Kosaka et al. | |
| 2007/0212251 | A1 | 9/2007 | Otsuka et al. | |
| 2007/0251614 | A1 * | 11/2007 | Bhambri | A61L 27/06 148/669 |
| 2010/0074795 | A1 * | 3/2010 | Takahashi | C22C 14/00 420/420 |
| 2011/0180188 | A1 * | 7/2011 | Bryan | C22F 1/183 148/670 |

FOREIGN PATENT DOCUMENTS

| | | | |
|---|---|---|---|
| JP | 7-62474 | A | 3/1995 |
| JP | 7-70676 | A | 3/1995 |
| JP | 3076696 | B2 | 8/2000 |
| JP | 3076697 | B2 | 8/2000 |
| JP | 2001-288518 | A | 10/2001 |
| JP | 3306878 | B2 | 7/2002 |
| JP | 3409278 | B2 | 5/2003 |
| JP | 2005-524774 | A | 8/2005 |
| JP | 2005-320618 | A | 11/2005 |
| JP | 2010-7166 | A | 1/2010 |
| JP | 2012-149283 | A | 8/2012 |
| JP | WO2012108319 | * | 8/2012 |
| WO | WO 2012/108319 | A1 | 8/2012 |

OTHER PUBLICATIONS

Extended European Search Report dated Dec. 22, 2015, for European Application No. 13879564.6.

Bania et al., "A New Low Cost Titanium Alloy", Titanium '92 Science and Technology, Edited by F. H. Froes and I. L. Caplan, The Minerals, Metals & Materials Society, 1993, pp. 2787-2794.

International Search Report, mailed Oct. 1, 2013, issued in PCT/JP2013/071941.

Paul J. Bania, "Titanium Alloy Development in the U.S.", Metallurgy and Technology of Practical Titanium Alloys, Edited by S. Fujishiro, D. Eylon and T. Kishi, The Minerals, Metals & Materials Society, 1994, pp. 9-18.

Taiwanese Office Action 102129297 dated Aug. 20, 2014.

Written Opinion of the International Searching Authority, mailed Oct. 1, 2013, issued in PCT/JP2013/071941.

* cited by examiner

RESOURCE SAVING-TYPE TITANIUM ALLOY MEMBER POSSESSING IMPROVED STRENGTH AND TOUGHNESS AND METHOD FOR MANUFACTURING THE SAME

TECHNICAL FIELD

The present invention relates to a resource saving-type titanium alloy member that uses alloy elements abundant in resources and inexpensively available and, when added even in a smaller amount than conventional alloys, can simultaneously realize both high strength and high toughness, and a method for manufacturing the same.

BACKGROUND ART

Titanium alloys that are light-weight, have a high specific strength, and possess improved corrosion resistance have been utilized in extensive applications such as airplanes and, further, automobile components and civilian goods. Among them, Ti-6Al-4V that is an α+β alloy possessing an improved balance between strength and ductility is a representative example thereof. On the other hand, from the viewpoint of reducing a high cost that is one of factors which are an obstacle to popularization and expansion, alloys having properties that can be alternative to Ti-6Al-4V have been developed using as an additive element Fe that is abundant in resources and is available at a low cost.

α+β titanium alloys can realize an increase in the strength through thermomechanical treatment, but, when the strength increase, generally undergo a lowering in ductility and toughness. However, not only high strength but also high toughness is desired in α+β titanium alloys, because α+β titanium alloys are used, for example, in drives of automobiles and at sites that directly receive impact, such as golf clubs.

Forms of the microscopic structure of the α+β titanium alloy may be classified roughly into an equiaxed structure and an acicular structure. The acicular structure is advantageous in toughness but is poor in strength. In the acicular structure, a fine acicular structure obtained by quenching after solution treatment in a β single-phase area has higher strength and lower toughness than a coarse acicular structure obtained by mild cooling. Further, in the coarse acicular structure, a fatigue fracture is likely to begin at a coarsened α phase, and, thus, the coarse acicular structure is inferior in fatigue strength to the fine acicular structure.

In some cases, in the manufacturing process of Ti-6Al-4V, the cooling rate after the solution treatment in a β single-phase area is increased as a simple means that increases the strength or as a means that increases the productivity on a commercial scale. However, quenching after the solution treatment causes conversion of the microscopic structure to a fine acicular structure, resulting in a significant lowering in toughness of the Ti-6Al-4V alloy.

Ti-6Al-1.7Fe-0.1Si alloys described in Non-Patent Literature 1 and Non-Patent Literature 2 are high-strength and high-rigidity alloys, but on the other hand, the Al addition amount is so large that the toughness is poor.

Patent Literature 1 discloses an alloy consisting of Al: more than or equal to 4.4% and less than 5.5% and Fe: more than or equal to 0.5% and less than 1.4% as an α+β titanium alloy having a fatigue strength that is equal to conventional Ti—Al—Fe-base titanium alloys and that is stable and has little or no variation, and having a higher hot workability than the conventional Ti—Al—Fe-base titanium alloys. The addition amount of Si, however, is less than 0.25% for fatigue strength lowering reasons, and no mention is made of contribution to solid solution strengthening and toughness.

Patent Literature 2 discloses an alloy comprising Al: more than or equal to 4.4% and less than 5.5% and Fe: more than or equal to 1.4% and less than 2.1% as a titanium alloy having a fatigue strength that is equal to conventional Ti—Al—Fe-base titanium alloys, and having a higher hot or cold workability than the conventional Ti—Al—Fe-base titanium alloys. The addition amount of Si, however, is less than 0.25% for fatigue strength lowering reasons, and no mention is made of contribution to solid solution strengthening and toughness.

Patent Literature 3 discloses an alloy consisting of Al: 5.5% to 7.0%, Fe: 0.5% to 4.0%, and O: less than or equal to 0.5% as an α+β titanium alloy that can be manufactured at a low cost on a commercial scale and has mechanical properties more than or equal to Ti-6Al-4V alloys. This alloy, however, disadvantageously has poor toughness due to a large Al addition amount, and suffers from a problem of heterogeneous properties and lowered toughness due to Fe segregation when the Fe content is high.

Patent Literature 4 discloses an titanium alloy consisting of Al: 5.0% to 7.0%, Fe+Cr+Ni: 0.5% to 10.0%, and C+N+O: 0.01% to 0.5% and having a tensile strength of 890 MPa or more and a melting point of 1650° C. or below as cast, as a casting α+β titanium alloy that has a higher strength and a better castability than the Ti-6A-4V. This titanium alloy is an alloy that has good flowability in a melted state and has improved strength after solidification, but is unsatisfactory in strength.

Patent Literature 5 discloses a high-strength α+β alloy that consists of Al: 4.4% to 5.5%, Fe: 1.4% to 2.1%, Mo: 1.5% to 5.5%, and Si: less than 0.1% and has room-temperature strength and fatigue strength more than or equal to Ti-6Al-4V. The titanium alloy described in Patent Literature 5, however, contains a large amount of Mo that is expensive and causes a large price fluctuation, disadvantageously making it difficult to stably manufacture the titanium alloy at a low cost.

Patent Literature 6 discloses a high-strength and high-toughness α+β titanium alloy that has a Mo equivalent of 6.0 to 12.0 and has a controlled microscopic structure. The titanium alloy described in Patent Literature 6 should contain a large amount of Mo that is an expensive alloy element, resulting in a high cost.

Patent Literature 7 discloses a Si-containing near-β titanium alloy. In Patent Literature 7, the near-β titanium alloy is an object alloy, and, like Ti-10V-2Fe-3Al and Ti-5Al-2Sn-2Zr-4Mo-4Cr as exemplified in the specification, V and Mo that are expensive alloy elements are contained in a large amount, thus resulting in a high cost.

PRIOR ART LITERATURE(S)

Patent Literature(s)

[Patent Literature 1] JP 3076697B

[Patent Literature 2] JP 3076696B

[Patent Literature 3] JP 3306878B

[Patent Literature 4] JP 2010-7166A

[Patent Literature 5] JP 2005-320618A

[Patent Literature 6] JP 2001-288518A
[Patent Literature 7] JP 3409278A

Non-Patent Literature(s)

[Non-Patent Literature 1] P. Bania, Metallugy and Technology of Practical Titanium Alloys, p. 9, TMS, Warrendale, Pa. (1994)
[Non-Patent Literature 2] F. H. FROES and I. L. CAPLAN, TITANIUM '92 SCIENCE AND TECHNOLOGY, p. 2787

SUMMARY OF THE INVENTION

Problem(s) to be Solved by the Invention

For α+β titanium alloy members that use inexpensive raw materials and have an alloy addition amount which is smaller than the titanium alloy, any technique that can simultaneously meet strength and toughness on a high level has not hitherto been disclosed.

When an acicular structure is adopted from the viewpoint of enhancing the toughness of the α+β titanium alloy member, the strength is disadvantageously lowered.

Accordingly, an object of the present invention is to provide a titanium alloy member that can solve the above problems, is more inexpensive than conventional α+β titanium alloys and can simultaneously meet strength and toughness on a high level, and a method for manufacturing the same.

Means for Solving the Problem(s)

In order to solve the above problems, the inventors of the present invention have earnestly made studies on the strength and toughness of titanium alloy members containing, as reinforcing elements, Fe that is less expensive than V and Mo, and Si that, even when added in a small amount, can highly enhance the strength and toughness, the titanium alloy members having been subjected to various heat treatments.

The inventors of the present invention have used a tensile strength of 985 MPa or more and a Charpy impact value of 30 J/cm$^2$ or more as measured using a 2 mm V-notched notch specimen, each at room temperature, as a measure of the strength and as a measure of the toughness, respectively. The room-temperature strength is specified to be 895 MPa or more in extensively used Ti-6Al-4V and, thus, in the present invention, has been specified to be 10% or more above this value. Further, since the standard Charpy impact absorption energy of Ti-6Al-4V is 24 J, that is, 30 J/cm$^2$, an impact value higher than this value has been adopted as a measure.

The addition of Si to the titanium alloy in many cases aims at an improvement in creep resistance in applications where heat resistance is required. The upper limit of the addition amount of Si is in many cases near solubility limit from the viewpoint of inhibiting the production of silicide.

The inventors of the present invention have evaluated strength and toughness after various heat treatments of titanium alloy members with Al, Fe, and Si added thereto. As a result, it has been found that a titanium alloy member having improved strength and toughness can be produced by regulating the content ranges of Al, Fe, O, and Si to respective proper content ranges and subjecting the alloy to heat treatment in such a manner that the microscopic structure is an acicular structure having a mean width of less than 5 μm in an acicular α phase.

The gist of the present invention is as follows.

(1)

A titanium alloy member consisting of, in mass %,
Al: more than or equal to 4.5% and less than 5.5%,
Fe: more than or equal to 1.3% and less than 2.3%,
Si: more than or equal to 0.25% and less than 0.50%,
O: more than or equal to 0.05% and less than 0.25%, and
the balance: titanium and unavoidable impurities, wherein the titanium alloy member has a microscopic structure that is an acicular structure having an acicular α phase with a mean width of less than 5 μm.

(2)

The titanium alloy member according to (1), wherein the acicular α phase has a mean width of less than 2 μm.

(3)

A method for manufacturing a titanium alloy, the method including:

molding an ingot into a parent metal member, the ingot consisting of, in mass %,
Al: more than or equal to 4.5% and less than 5.5%,
Fe: more than or equal to 1.3% and less than 2.3%,
Si: more than or equal to 0.25% and less than 0.50%,
O: more than or equal to 0.05% and less than 0.25%, and
the balance: titanium and unavoidable impurities; and subjecting the parent metal member to heat treatment involving holding the parent metal member at or above a β transformation temperature for five minutes or longer and cooling the parent metal member at a rate of air cooling or more.

(4) The method for manufacturing a titanium alloy member according to (3), wherein the cooling in the heat treatment step is water cooling.

Effect(s) of the Invention

The titanium alloy member according to the present invention is one that is obtained by heat treatment in which the material is held at or above a β transformation temperature for five minutes or more followed by cooling at a high rate of air cooling or more, the titanium alloy member having an acicular structure with a mean width of less than 5 μm in an acicular α phase. Thus, both strength and toughness requirements can be simultaneously met without sacrificing the productivity.

The titanium alloy member according to the present invention uses additive elements that are abundant in resources and inexpensively available and that has strength and toughness higher than conventional titanium alloys. Thus, the titanium alloy member according to the present invention, as compared with conventional high-strength titanium alloys, can find more extensive industrial applications as members of drives such as automotive engine valves or connecting rods, as fastener members, or as members that receive impact, such as golf club faces, leading to a wide range of effects such as the effect of resource savings and the effect of improving fuel consumption, for example, in automobiles. Further, the titanium alloy member according to the present invention can be utilized in a wide range of applications including the above civilian goods, can offer a wide variety of effects, and thus have an immeasurable industrial value.

BRIEF DESCRIPTION OF THE DRAWING(S)

MODE(S) FOR CARRYING OUT THE INVENTION

Figure 1:
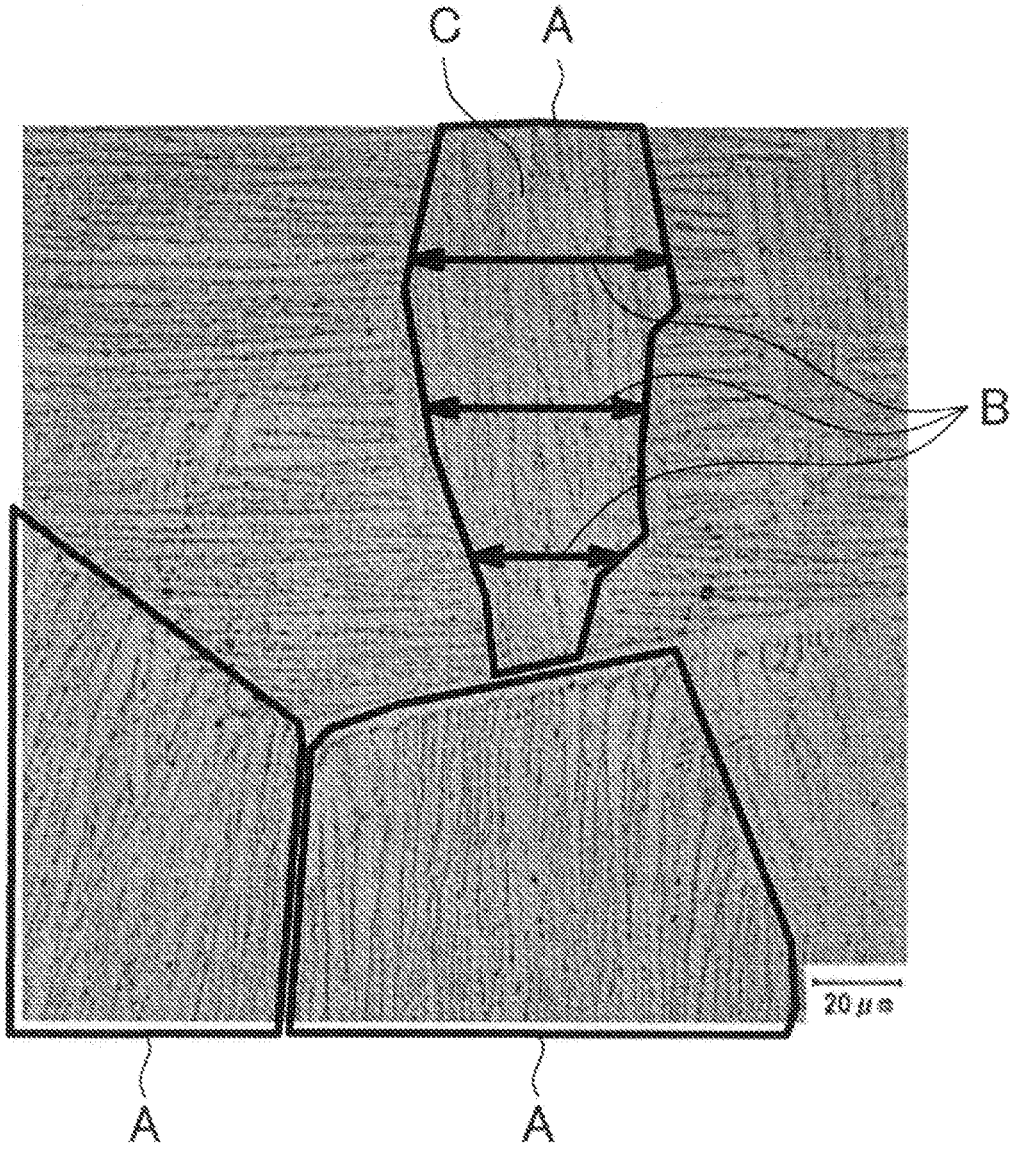
FIG. 1 is an optical photomicrograph of a titanium alloy member according to an embodiment of the present invention.

The present invention will be described in more detail.

In the course of development, an experiment was carried out in which a Ti-5% Al-1-2% Fe-base alloy previously developed as a low-cost Fe-containing high-strength α+β titanium alloy was used as a base and the effect of Si addition and heat treatment on strength and toughness was examined.

As a result, Al, Fe, and oxygen improve the strength and, at the same time, lower the toughness. On the other hand, it has been found that, when Si is added to supersaturation, the strength and toughness can be improved by regulating a microscopic structure through proper heat treatment.

In examining the effect of the addition of Si and heat treatment on the strength and toughness of the α+β titanium alloy member, specimens formed of various α+β titanium alloy members were manufactured by molding round bars (diameter: 15 mmϕ) having various compositions and subjecting the round bars to various heat treatment, and were then evaluated. Methods for evaluation of strength and toughness of the specimens will be described.

The tensile strength was evaluated by the following tensile test at room temperature. A round bar-shaped tensile specimen having a diameter of 6.25 mmϕ and a length of 32 mm at a parallel portion, and gauge length (GL)=25 mm was extracted from the specimen, and the tensile test was carried out at a tensile speed of 1 mm/min until 0.2% proof stress and 10 mm/min after 0.2% proof stress.

The toughness was evaluated in terms of an impact value ($J/cm^2$) by a Charpy impact test at room temperature. A sub size specimen as specified in Japanese Industrial Standards (JIS) Z 2242 was extracted, the sub size specimen being prepared from the specimen by providing a V-notch having a depth of 2 mm in a quadratic prism form having a width of 5 mm and a size of 5×10×55 mm, and the impact test was carried out with a 300 N Charpy impact testing machine.

Next, a method for observation of a microscopic structure of the specimen will be described.

The microscopic structure was observed by mirror-polishing a C cross section of the round bar specimen, that is, a cross section perpendicular to a central axis of the round bar, corroding the specimen with a Kroll's solution to expose the microscopic structure, and observing the microscopic structure under an optical microscope.

The "mean width of acicular α phase" of the acicular structure used herein refers to a value obtained by observing a cross section perpendicular to a rolling direction of the titanium alloy member under an optical microscope and calculating the mean width by the following method.

The width of the acicular α phase sometimes varies depending upon an orientation relationship between the observation surface and the structure. For this reason, old β grains and colonies present inside the grains were observed at five or more observation points (an area within the visual field of the optical microscope). Here the colony is an area where the direction of the axis of the acicular structure (acicular α phase) observed within old β grains is substantially uniform. The acicular structure is composed of an acicular α phase and surrounding β phase.

Figure 2:
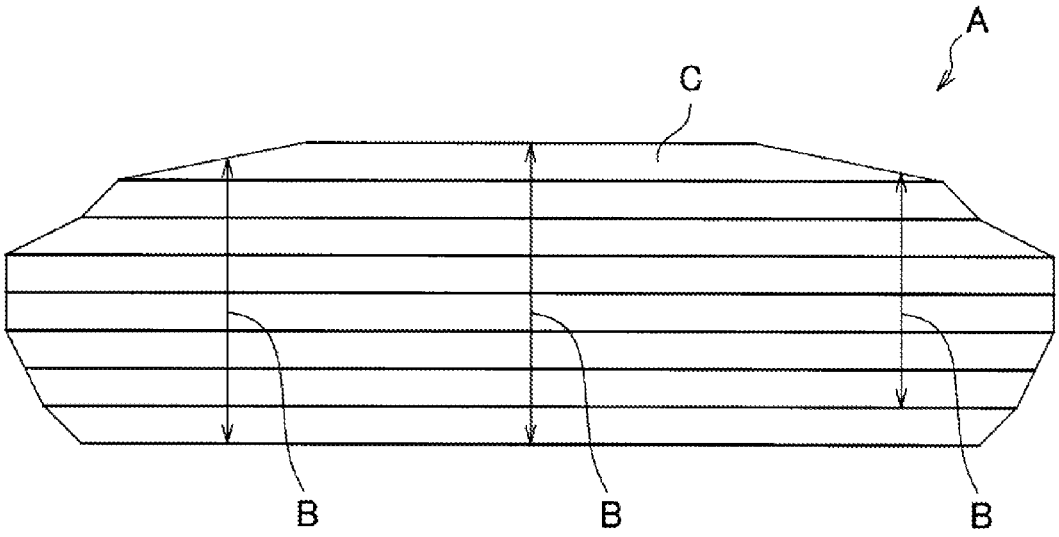
FIG. 2 is an explanatory view illustrating a method for calculation of a mean width of an acicular α phase.

The method for calculation of the mean width of the acicular α phase will be described in more detail with reference to FIGS. 1 and 2. FIG. 1 is an optical photomicrograph of a titanium alloy member according to an embodiment of the present invention, and FIG. 2 is an explanatory view illustrating an outline of a colony A. As illustrated in FIGS. 1 and 2, the colony A refers to an area where the axial direction of the acicular α phase C is substantially uniform.

At the outset, the mean width of the acicular α phase C constituting one colony A (hereinafter referred to as "mean width in the colony A") is calculated. Specifically, in any desired place of the colony, a plurality of straight lines B (for example, about 3 to 5 straight lines; three straight lines in Example and Comparative Example that will be described later) are drawn that extend vertically to the axial direction of the acicular α phase C constituting the colony A and connect boundaries of the colony A to each other. The mean width of the acicular α phase in each of the straight lines B is calculated by dividing the length of each of the straight lines B by the number of acicular α phases C that cross the straight line B. The mean width in the colony A is calculated by calculating the arithmetic mean of the mean width in each of the straight lines B. Since a plurality of straight lines are drawn in the colony A, the mean width in the colony A can be said to reflect the width of the whole acicular α phase constituting the colony A.

Further, the above treatment is carried out in a plurality of colonies A (for example, about 10 to 20 colonies; and 10 colonies in Examples and Comparative Examples that will be described later) within one observation point, and a mean width is calculated within one observation point by calculating an arithmetic mean of the mean width (mean width in colony A). Since, in the mean width in the observation point, a plurality of colonies A within the observation point are taken into consideration, it can be said that the width of the whole acicular α phase observed in the observation point is reflected.

Further, the above treatment is carried out at a plurality of observation points (for example, about five to ten observation points; and five observation points in Examples and Comparative Examples that will be described later), and an arithmetic mean of the mean width in each of the observation points is calculated to determine the mean width of the acicular α phase. Thus, the mean width of the acicular α phase is a value obtained by averaging the mean widths at the plurality observation points, and, thus, it can be said that the mean width of the acicular α phase reflects the width of the whole acicular α phase constituting the titanium alloy material.

The microscopic structure of the titanium alloy member according to the present invention is an acicular structure having an acicular α phase with a mean width of less than 5 μm obtained by subjecting the titanium alloy member to solution treatment at or above a β transformation temperature and then cooling the treated titanium alloy member at a cooling speed of air cooling or more.

In general, in the α+β titanium alloy including Ti-6Al-4V, an acicular microscopic structure can be obtained by heat treatment at or above a β transformation temperature. More specifically, the acicular structure in the titanium alloy member is formed by the precipitation of an α phase within or at boundaries of grains in a single phase.

In the titanium alloy member according to the present invention, when the cooling rate after the solution treatment is low, a microscopic structure formed of a thick acicular α phase is formed. When the cooling rate after the solution treatment is high, a martensitic structure or a microscopic structure formed of a fine acicular α phase is formed. For example, in the titanium alloy member that has been water-cooled after the solution treatment, a martensitic extremely fine structure or a Basketweave structure is observed, and both the structures are a structure having a width of the fine acicular α phase. These are described as an acicular structure.

Figure 3:
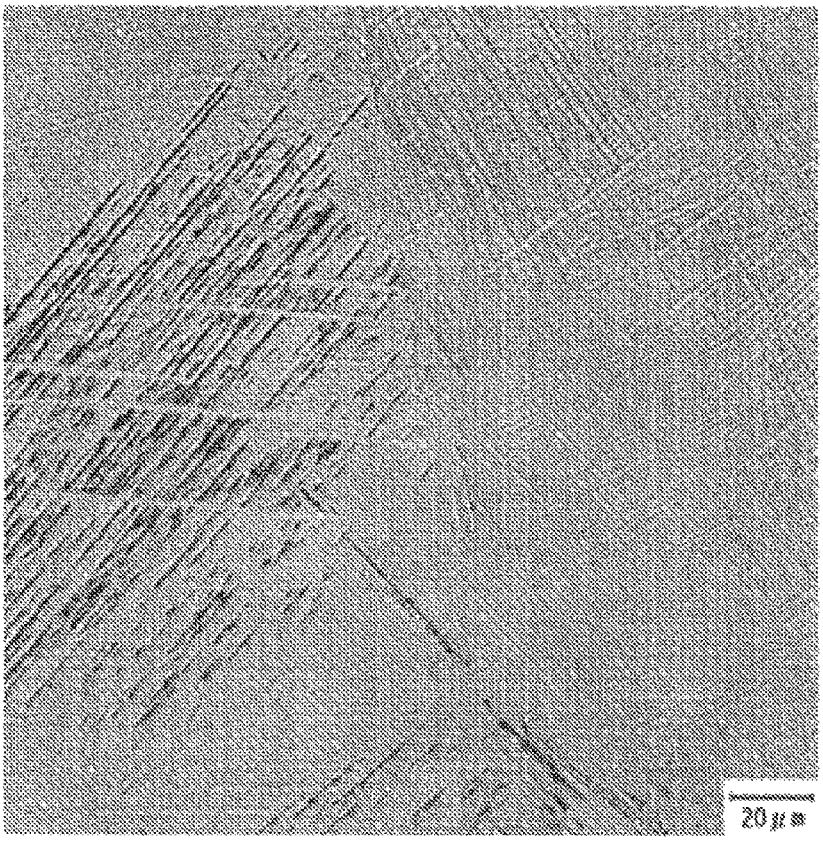
FIG. 3 is an optical photomicrograph of a titanium alloy member according to an embodiment of the present invention.

When the cooling rate after the solution treatment is high, a martensitic α phase can be precipitated. The martensitic α phase is one form of the acicular α phase and refers to an area where the acicular α phase extends in a plurality of directions (in other words, acicular α phases cross each other). That is, when the cooling rate is high, the α phase grows in various directions. In the cooling rate of ordinary quenching (for example, water cooling), however, the martensitic α phase hardly precipitates. One example of the martensitic α phase is shown in FIG. 3. FIG. 3 is an optical photomicrograph of a titanium alloy member according to an embodiment of the present invention.

When a martensitic α phase is contained in the titanium alloy member, the mean width of the acicular α phase is calculated as follows. Specifically, a group of acicular α phases having a substantially identical axial direction and adjacent to each other is extracted as one colony A from the martensitic α phase. Thereafter, the mean width of the martensitic α phase is calculated by a method that is identical to the above method.

When the microscopic structure is observed under an optical microscope, an error sometimes occurs because the width of the acicular α phase in the acicular structure varies depending upon relative relationship between the observation surface and the orientation of the axis of the acicular structure. Here as described above, the error has been eliminated by using the mean value of the width of the acicular α phase obtained by the observation of the acicular structure at five or more observation points. The colony is an area where the orientation within old β grains is uniform.

A titanium alloy member was obtained by holding a parent metal member molded into a round bar having a predetermined composition falling within the present invention and having a diameter of 20 mmϕ at or above a β transformation temperature for five minutes or more and air-cooling the round bar, as an example of the α+β titanium alloy member according to the present invention. In this case, an acicular structure in which the mean width of the acicular α phase is less than 5 μm was obtained, and an acicular structure in which the mean width is less than 2 μm was obtained by adopting water cooling instead of air cooling. In the center of a round bar having a diameter of 20 mmϕ, the rate of cooling from the β transformation temperature or above at which the round bar was held, to about 500° C. is 1° C./sec or above for air cooling and is 10° C./sec or above for water cooling.

On the other hand, an acicular structure in which the mean width of the acicular α phase is 10 to 30 μm was obtained by adopting furnace cooling instead of air cooling.

Accordingly, in an embodiment of the present invention, the cooling rate from the heating temperature to about 500° C. may be 1° C./sec or above. When the cooling rate is 1° C./sec or above, the mean width of the acicular α phase is less than 5 μm. The cooling rate is a cooling rate of the surface of the titanium alloy member.

The β transformation temperature of the titanium alloy according to the present invention varies depending upon the composition but is around 1000° C. Si forms a silicide of TixSiy, and the temperature at which the silicide is dissolved as a solid solution is approximately 900° C. to 1050° C. when the alloy falls within the alloy composition specified in the present invention. The larger the Si addition amount, the higher the temperature at which the silicide is dissolved as the solid solution.

When the distribution of the elements was investigated by an EPMA analysis, in the obtained titanium alloy member, there was no clear deviation in distribution for all of Al, Fe, and Si in an experiment where the titanium alloy member was held at or above the β transformation temperature for five minutes or more and was then cooled with water. When air cooling was adopted instead of water cooling, in the obtained titanium alloy member, a change was observed in the distribution of Al and Fe. It is considered that Al and Fe are mainly migrated into an α phase and a β phase, respectively. On the other hand, also when air cooling was adopted instead of water cooling, there was no deviation in Si distribution.

In an experiment where the material was held at or above the β transformation temperature for five minutes or more followed by furnace cooling, in the obtained titanium alloy member, there was a more clear separation of distribution of Al and Fe, and Si was also distributed in a large amount in a β phase.

Based on the above results, it was estimated that, in the titanium alloy member according to the present invention, since the migration rate of Si in cooling from the β transformation temperature is slow, when the material is held at or above the β transformation temperature for five minutes or more followed by cooling at a cooling rate of air cooling or more, even the addition of Si in an amount of 0.25% or more can allow a supersaturated solid solution state to be kept and contribution to an improvement in strength and toughness to be maintained.

As described above, in an experiment where a parent metal member having a predetermined composition according to the present invention is held at or above a β transformation temperature for five minutes or more and cooled at a cooling rate of air cooling or more, an acicular structure in which the mean width of the acicular α phase is less than 5 μm is obtained. Heat treatment that can provide such a microscopic structure can suppress coarsening of silicide due to hampering by a fine acicular structure even when silicide is present in the titanium alloy member after heat treatment. As a result, a lowering in toughness derived from coarse silicide is suppressed. Accordingly, it is estimated that, in the α+β titanium alloy member according to the present invention that has the microscopic structure, the effect of improving the strength and toughness by Si contained on a supersaturated level can be satisfactorily attained.

The titanium alloy member according to an embodiment of the present invention has high strength and high toughness and thus can be utilized in an extensive applications such as aircrafts and, further, automobile components and civilian goods. The thickness of the titanium alloy member used in these applications may vary. When the surface of a thick titanium alloy member is merely quenched, a difference in cooling rate may occur between the surface of the titanium alloy member and the inside of the titanium alloy member. On the other hand, the crystal structure may vary depending upon the cooling rate. For example, when a certain area in a titanium alloy member is cooled at 3° C./sec, the crystal structure of the area is as illustrated in FIG. 1; and, when the area is cooled at 20° C./sec, the crystal structure of the area may be as illustrated in FIG. 3. Accordingly, when the cooling rate of the surface of the crystal is different from the cooling rate of the inside of the crystal, in some cases, a difference occurs between the crystal structure of the surface and the crystal structure of the inside. Even if a difference exists between the crystal structure of the surface of the titanium alloy member and the crystal structure of the inside of the titanium alloy member, the strength and the toughness are excellent when requirements in the embodiment of the present invention (that is, requirements that the titanium alloy member satisfies the specific composition and has an acicular α phase having a mean width of less than 5 μm) are satisfied. Accordingly, this titanium alloy member falls within the scope of the embodiment of the present invention. Preferably, however, the crystal structure is uniform over the whole area of the titanium alloy member. This is because a higher level of uniformity of the crystal structure can contribute to a higher level of increase in the strength and the toughness, that is, a better effect of the embodiment of the present invention.

Accordingly, in particular, when the titanium alloy member is thick, preferably, the titanium alloy member is cooled, for example, by the following method. Specifically, a temperature range from the heating temperature to 500° C. is divided into predetermined ranges (for example, every 100° C.). Treatment consisting of cooling the surface of the titanium alloy member by the predetermined temperature range through water cooling or the like and keeping the temperature constant is repeated. Here the cooling rate in the cooling and the constant-temperature time are set so that the average cooling rate from the heating temperature to 500° C. is 1° C./sec or more.

For example, when the heating temperature is 1000° C., a procedure consisting of water-cooling the surface of the titanium alloy member to 900° C. and then keeping the temperature at 900° C., then water-cooling the surface of the titanium alloy member to 800° C., and then keeping the temperature at 800° C. is carried out. This procedure is repeated until the temperature of the titanium alloy member reaches about 500° C. In a constant-temperature period, the inside temperature is lowered and reaches the surface temperature, and, thus, a difference between the cooling rate of the surface and the cooling rate of the inside in the titanium alloy member can be reduced by the above treatment. Thus, the difference in crystal structures between the surface of the titanium alloy member and the inside of the titanium alloy member can be reduced.

There is no particular limitation on the upper limit of the cooling rate. In water cooling, a cooling rate of about 70 to 80° C./sec is feasible although the cooling rate varies depending upon the shape of the titanium alloy member. Even when the titanium alloy member is cooled at this cooling rate, the titanium alloy member in the embodiment of the present invention is completed. That is, even when the cooling rate is increased to 70 to 80° C./sec, there is no significant lowering in toughness. Accordingly, the upper limit of the cooling rate may be, for example, about 70 to 80° C./sec.

A method may also be adopted that includes holding a formed parent metal member containing a parent metal ingredient of the titanium alloy member according to the present invention at or above the β transformation temperature for five minutes or more, air-cooling the member to form an acicular structure having an acicular cc phase with a mean width of less than 5 μm, and then subjecting the member to additional heat treatment at 650° C. to 850° C. for microscopic structure stabilization. The thermal strain produced within the titanium alloy member by quenching can be reduced by additional treatment (the so-called annealing). That is, the microscopic structure is stabilized.

Accordingly, in the acicular structure of the titanium alloy member according to the present invention, it is estimated that, even after the additional heat treatment for structure stabilization purposes, the solid solution state of Si contained in a supersaturated state is kept and contribution to an improvement in strength and toughness is maintained.

In the titanium alloy member according to the present invention described in claim 1, the content ratio of constituent elements of a parent metal (a titanium alloy member) and the form of the microscopic structure are specified.

Al is an cc stabilizing element, and, when Al is dissolved as a solid solution in cc phase, the strength of the titanium alloy member increases with an increase in content. When the content of Al in the parent metal is 5.5% or more, the toughness is deteriorated. For this reason, the content of Al in the parent metal is more than or equal to 4.5% and less than 5.5%. The upper limit of the Al content is more preferably less than 5.3%. The lower limit of the Al content is more preferably more than or equal to 4.8%.

Fe is a eutectoid β stabilizing element that, when dissolved as a solid solution in β phase, increases the room-temperature strength of the titanium alloy member, but on the other hand, lowers the toughness with an increase in content. The content of Fe in the parent metal should be more than or equal to 1.3% from the viewpoint of ensuring the strength. When the content of Fe in the parent metal is more than or equal to 2.3% or more, a problem of segregation occurs in melt-preparation in a large ingot. For this reason, the content of Fe in the parent metal is more than or equal to 1.3% and less than 2.3%. The upper limit of the Fe content is more preferably less than 2.1%. The lower limit of the Fe content is more preferably more than or equal to 1.5%.

Si is a β stabilizing element and increases the strength and the toughness with an increase in content. The content of Si in the parent metal should be more than or equal to 0.25% from the viewpoint of ensuring the strength and the toughness. On the other hand, when the content of Si in the parent metal is more than or equal to 0.50%, the toughness is lowered. For this reason, the content of Si in the parent metal is more than or equal to 0.25% and less than 0.50%. The upper limit of the Si content is more preferably less than 0.49%. The lower limit of the Si content is more preferably more than or equal to 0.28%.

O is an element that strengthens an α phase. In order to develop the contemplated effect, the content of 0 in the parent metal should be more than or equal to 0.05%. An O content of more than or equal to 0.25%, however, disadvantageously promotes the production of an $\alpha_2$ phase that renders the material embrittle, or causes a rise in β transformation temperature that increases a heat treatment cost. For this reason, the content of 0 in the parent metal is more than or equal to 0.05% and less than 0.25%. The O content is preferably more than or equal to 0.08% and less than 0.22%. The O content is more preferably more than or equal to 0.12% and less than 0.20%.

The microscopic structure of the titanium alloy member according to the present invention is an acicular structure in which the mean width of the acicular α phase is less than 5 μM. When the α phase is coarsened, the toughness is lowered. For this reason, the mean width of the acicular α phase is less than 5 μm, preferably less than or equal to 4 μM, more preferably less than 2 μm.

A titanium alloy member having an acicular α phase with a mean width of less than 5 μm is free from deviation in Si distribution caused by solution treatment, can maintain a solid solution state of Si contained on a supersaturated level, and can realize suppression of coarse silicide-derived lowering in toughness. Thus, the titanium alloy member has improved strength and toughness. In the titanium alloy member, when the mean width of the acicular α phase is less than 2 μm, the titanium alloy member is free from solution treatment-derived deviation in distribution of Al, Fe, and Si, and the solid solution state of these elements is maintained. Thus, the titanium alloy member has improved strength and toughness.

The shape of the titanium alloy member according to the present invention is not particularly limited and may be in a bar or plate form. The shape of the parent metal, that is, the parent metal member, according to the present invention may be, for example, in the form of automobile engine valves, connection rods, and golf club faces. The parent metal member is formed by hot rolling, hot forging, hot extrusion, cutting/grinding or a combination thereof.

The method for manufacturing a titanium alloy member according to the present invention includes molding an ingot containing ingredients of a parent metal of the titanium alloy member according to the present invention to obtain a parent metal member and subjecting the parent metal member to heat treatment involving holding the parent metal member at or above a β transformation temperature for five minutes or more and cooling the parent metal member at a rate of air cooling or more.

In the heat treatment step, when the parent metal member is held at or above a β transformation temperature for five minutes or more, the alloy compositions can be satisfactorily dissolved into the member and, thus, a satisfactory effect of improving the strength and the toughness can be attained. Cooling at a rate of air cooling or more can provide an acicular structure in which the mean width of the acicular α phase is less than 5 μm without deviation in Si distribution. When the cooling is water cooling, an acicular structure can be obtained free from deviation in distribution of Al, Fe, and Si, and having an acicular α phase with a mean width of less than 2 μm. When the cooling rate is less than air cooling, the acicular α phase is coarsened, resulting in lowered toughness.

The titanium alloy member according to the present invention can be manufactured by a commonly used method for manufacturing a titanium alloy. The titanium alloy member according to the present invention is manufactured through the following representative manufacturing steps.

At the outset, an ingot of ingredients of the parent metal in the titanium alloy member according to the present invention is formed while preventing the inclusion of impurities by a melting method including providing a sponge-shaped titanium alloy material and alloy materials as a starting material, melting the starting material in vacuum by arc melting or electron beam melting, and casting the melt in a water-cooled copper mold. Here 0 can be added, for example, by using titanium oxide or a sponge titanium having a high oxygen concentration in melting.

Next, the ingot is formed into a parent metal member (forming step). Specifically, the ingot is heated to an α+β region or a β region at 950° C. or above, is then forged into a billet, is subjected to surface cutting, and is hot-rolled at a heating temperature of 950° C. or above. Thus, a parent metal member in a bar form of 12 to 20 mmφ that is an example of the shape of the titanium alloy member according to the present invention is obtained.

Next, the parent metal member formed into the shape of the titanium alloy member according to the present invention is held for 5 to 60 minutes at or above a β transformation temperature that is around 1000° C. although the temperature varies depending upon ingredients, followed by cooling at a cooling rate of air cooling or more (heat treatment step). When the holding time is less than five minutes, solutionalization is unsatisfactory. When the holding time is more than 60 minutes, the grain diameter of the β phase is unfavorably too large.

The heat treatment step is preferably carried out at or above a β transformation temperature+20° C. to 1100° C. for a holding time of 10 to 30 minutes, more preferably at or above a β transformation temperature+20° C. to 1060° C. for a holding time of 15 to 25 minutes.

A heat treatment temperature of a β transformation temperature+20° C. and/or a holding time of 10 minutes or more can provide a titanium alloy member into which alloy compositions have been dissolved even when there is a variation in ingredients of the parent metal member and the temperature of the parent metal member during the heat treatment, contributing to a more effective improvement in strength and toughness. A heat treatment temperature above 1100° C. and/or a holding time of more than 30 minutes disadvantageously pose problems such as a tendency towards coarsening of the microscopic structure of the titanium alloy member and an increase in heat treatment cost.

After the heat treatment step, an additional heat treatment may be carried out at 650 to 850° C. for 30 minutes to four hours from the viewpoint of stabilizing the quality of material.

EXAMPLE(S)

The present invention will be described in more detail with reference to the following Examples.

Experiment Example 1

Titanium alloys containing ingredients of material Nos. 1 to 15 shown in Table 1 were manufactured by a vacuum arc melting process, and ingots (about 200 kg) were prepared from the titanium alloys. These ingots were forged and hot-rolled into round bars having a diameter of 15 mm.

TABLE 1

| Material | Alloy compositions(mass %) | | | | β Transformation | |
|---|---|---|---|---|---|---|
| No. | Al | Fe | O | Si | temperature (° C.) | Remarks |
| 1 | 5.0 | 1.5 | 0.17 | 0.40 | 1001 | Present invention |
| 2 | 5.4 | 1.8 | 0.16 | 0.30 | 1001 | Present invention |
| 3 | 5.2 | 2.2 | 0.15 | 0.32 | 988 | Present invention |
| 4 | 5.4 | 2.1 | 0.09 | 0.45 | 976 | Present invention |
| 5 | 4.8 | 2.0 | 0.20 | 0.28 | 996 | Present invention |
| 6 | 4.5 | 1.6 | 0.22 | 0.35 | 1001 | Present invention |
| 7 | 5.3 | 2.0 | 0.16 | 0.26 | 995 | Present invention |
| 8 | 4.7 | 1.6 | 0.15 | 0.48 | 988 | Present invention |
| 9 | 4.0 | 2.0 | 0.18 | 0.30 | 973 | Comparative Example |
| 10 | 5.0 | 1.0 | 0.18 | 0.33 | 1012 | Comparative Example |

TABLE 1-continued

| Material No. | Alloy compositions(mass %) Al | Fe | O | Si | β Transformation temperature (° C.) | Remarks |
|---|---|---|---|---|---|---|
| 11 | 6.0 | 1.5 | 0.18 | 0.13 | 1023 | Comparative Example |
| 12 | 5.4 | 2.0 | 0.15 | 0.01 | 993 | Comparative Example |
| 13 | 6.0 | 1.4 | 0.20 | 0.30 | 1031 | Comparative Example |
| 14 | 5.3 | 1.5 | 0.28 | 0.45 | 1036 | Comparative Example |
| 15 | 5.0 | 1.8 | 0.15 | 0.60 | 991 | Comparative Example |

The round bars containing ingredients of material Nos. 1 to 15 were subjected to solution treatment by holding at 1050° C. for Nos. 1, 2, 5, 6, and 7, at 1040° C. for Nos. 3, 8, 12, and 15, at 1030° C. for Nos. 4 and 9, and at 1060° C. for Nos. 10, 11, 13, and 14 each for 15 to 25 minutes and air-cooling the bars to form microscopic structures each formed of an acicular structure. The β transformation temperature of each of material Nos. 1 to 15 is shown in Table 1.

For the round bars of test Nos. 1 to 15 after the solution treatment, the tensile strength and the toughness were evaluated by the following method.

The tensile strength was evaluated by the following tensile test at room temperature. A round bar-shaped tensile specimen having a diameter of 6.25 mmϕ and a length of 32 mm at a parallel portion, and gauge length (GL)=25 mm was extracted from the round bar, and the tensile test was carried out at a tensile speed of 1 mm/min until 0.2% proof stress and 10 mm/min after 0.2% proof stress.

The toughness was evaluated in terms of an impact value ($J/cm^2$) by a Charpy impact test at room temperature. A sub size specimen as specified in JIS Z 2242 was extracted, the sub size specimen being prepared from the round bar by providing a V-notch having a depth of 2 mm in a quadratic prism form having a width of 5 mm and a size of 5×10×55 mm, and the impact test was carried out with a 300 N Charpy impact testing machine.

For the test Nos. 1 to 15 thus obtained, the evaluation results of the tensile strength and the impact value are shown in Table 2.

TABLE 2

| Material No. | Test No. | Micro-scopic structure | Width of α phase (μm) | Tensile strength (MPa) | Impact value ($J/cm^2$) | Remarks |
|---|---|---|---|---|---|---|
| 1 | 1 | Acicular | 3.2 | 993 | 41 | Present invention |
| 2 | 2 | Acicular | 3.3 | 1024 | 34 | Present invention |
| 3 | 3 | Acicular | 3.0 | 1031 | 32 | Present invention |
| 4 | 4 | Acicular | 2.6 | 994 | 32 | Present invention |
| 5 | 5 | Acicular | 3.0 | 1032 | 37 | Present invention |
| 6 | 6 | Acicular | 3.3 | 1010 | 41 | Present invention |
| 7 | 7 | Acicular | 2.8 | 1020 | 32 | Present invention |
| 8 | 8 | Acicular | 2.7 | 989 | 46 | Present invention |
| 9 | 9 | Acicular | 2.6 | 972 | 41 | Comparative Example |

TABLE 2-continued

| Material No. | Test No. | Micro-scopic structure | Width of α phase (μm) | Tensile strength (MPa) | Impact value ($J/cm^2$) | Remarks |
|---|---|---|---|---|---|---|
| 10 | 10 | Acicular | 3.5 | 962 | 48 | Comparative Example |
| 11 | 11 | Acicular | 3.7 | 1006 | 15 | Comparative Example |
| 12 | 12 | Acicular | 3.0 | 952 | 22 | Comparative Example |
| 13 | 13 | Acicular | 4.0 | 1068 | 18 | Comparative Example |
| 14 | 14 | Acicular | 4.3 | 1105 | 17 | Comparative Example |
| 15 | 15 | Acicular | 3.2 | 991 | 27 | Comparative Example |

Further, a cross section perpendicular to a central axis of each of round bars of test Nos. 1 to 15 after the solution treatment was subjected to mirror polishing, and the mirror polished cross section was then corroded with a Kurrol liquid to expose a microscopic structure. The microscopic structure was observed under an optical microscope at a magnification of 500 times, and the mean value of the width of the acicular α phase in the microscopic structure was determined. The results are shown in Table 2.

Test Nos. 1 to 8 are Examples of the present invention, and test Nos. 9 to 15 are Comparative Examples where any material ingredient (constituent element of the parent metal) is outside the scope of the present invention.

In Tables 1 and 2, numeric values outside the scope of the present invention are underlined.

In each of Examples of the present invention (test Nos. 1 to 8), the microscopic structure had an acicular α phase with a mean width of less than 5 and the tensile strength of 985 MPa or more, and the Charpy impact value of 30 $J/cm^2$ or more, indicating that the strength and the toughness were good.

For No. 9 as Comparative Example where the Al content was below the lower limit, and for test No. 10 as Comparative Example where the Fe content was below the lower limit, the tensile strengths were unsatisfactory. For test No. 11 as Comparative Example where the Al content was above the upper limit and the Si content was below the lower limit, the impact value was unsatisfactory. For test No. 12 where the Si content was below the lower limit, the room-temperature strength and the impact value were unsatisfactory. For test No. 13 where the Al content was above the upper limit, the impact value was unsatisfactory. For test No. 14 where the 0 content was above the upper limit and for test No. 15 where the Si content was above the upper limit, the impact values were unsatisfactory.

Experiment Example 2

For the round bars containing ingredients of material Nos. 1 to 15 identical to those of Example 1, solution treatment was carried out in which these materials were held for 60 minutes at a temperature of 870° C. that was below the β transformation temperature of these materials, followed by water cooling. Thus, round bars of test Nos. 16 to 30 were obtained.

For each of round bars of test Nos. 16 to 30, the toughness was evaluated in the same manner as in Experiment Example 1. The results are shown in Table 3.

The microscopic structures of test Nos. 1 to 15 after the solution treatment were observed in the same manner as in Experiment Example 1. The results are shown in Table 3.

TABLE 3

| Material No. | Test No. | Microscopic structure | Impact value (J/cm$^2$) | Remarks |
|---|---|---|---|---|
| 1 | 16 | Equiaxial | 11 | Comparative Example |
| 2 | 17 | Equiaxial | 19 | Comparative Example |
| 3 | 18 | Equiaxial | 12 | Comparative Example |
| 4 | 19 | Equiaxial | 16 | Comparative Example |
| 5 | 20 | Equiaxial | 19 | Comparative Example |
| 6 | 21 | Equiaxial | 21 | Comparative Example |
| 7 | 22 | Equiaxial | 17 | Comparative Example |
| 8 | 23 | Equiaxial | 20 | Comparative Example |
| 9 | 24 | Equiaxial | 18 | Comparative Example |
| 10 | 25 | Equiaxial | 23 | Comparative Example |
| 11 | 26 | Equiaxial | 19 | Comparative Example |
| 12 | 27 | Equiaxial | 14 | Comparative Example |
| 13 | 28 | Equiaxial | 21 | Comparative Example |
| 14 | 29 | Equiaxial | 23 | Comparative Example |
| 15 | 30 | Equiaxial | 19 | Comparative Example |

Heating temperature is 870° C. that is at or below β transformation temperature.

For each of test Nos. 16 to 31, the impact value was less than 30 J/cm$^2$ and was unsatisfactory.

For each of test Nos. 16 to 31, the microscopic structure was an equiaxial structure formed of a mixed structure including a proeutectoid α phase and an acicular structure. This is because, in Experiment Example 2, the solution treatment was heat treatment that was carried out at temperature below the β transformation temperature.

Experiment Example 3

For round bars containing ingredients of material No. I identical to those of Experiment Example 1, solution treatment was carried out in which the round bars were held at 1050° C. for 20 minutes and were then cooled. In this case, cooling was carried out at a varied cooling rate of air cooling, water cooling, or furnace cooling. Thereafter, some of the round bars were subjected to additional heat treatment under the following conditions.

Test Nos. 31 and 32 are samples where water cooling was carried out after the solution treatment, and test No. 32 is a sample where heat treatment at 800° C. for one hour was carried out after the water cooling.

Test Nos. 33 to 36 are samples where the air cooling was carried out after solution treatment; test No. 34 is a sample where, after air cooling, heat treatment was carried out at 700° C. for two hours; test No. 35 is a sample where, after the air cooling, heat treatment was carried out at 800° C. for one hour; and test No. 36 is a sample where, after the air cooling, heat treatment was carried out at 850° C. for one hour.

Test Nos. 37 to 39 are samples where furnace cooling was carried out after solution treatment; and test No. 39 is a sample where additional heat treatment at 800° C. for one hour was carried out. Test No. 38 is a sample where furnace cooling was carried out under conditions that were different from those of No. 37.

The microscopic structure of each of test Nos. 31 to 39 after solution treatment (after additional heat treatment when the additional heat treatment was carried out) was observed in the same manner as in Experiment Example 1, and the mean value of the width of the acicular α phase in the microscopic structure was determined. The results are shown in Table 4.

For round bars of test Nos. 31 to 39, the tensile strength and the toughness were evaluated in the same manner as in Experiment Example 1. The results are shown in Table 4.

TABLE 4

| Test No. | Width of α phase (μm) | Tensile strength (MPa) | Impact value (J/cm$^2$) | Remarks |
|---|---|---|---|---|
| 31 | 1.1 | 1060 | 38 | Present invention |
| 32 | 1.8 | 1038 | 35 | Present invention |
| 33 | 3.2 | 993 | 41 | Present invention |
| 34 | 3.4 | 997 | 35 | Present invention |
| 35 | 3.8 | 993 | 41 | Present invention |
| 36 | 4.6 | 987 | 42 | Present invention |
| 37 | 10 | 973 | 25 | Comparative Example |
| 38 | 15 | 965 | 9 | Comparative Example |
| 39 | 24 | 974 | 23 | Comparative Example |

For each of test Nos. 31 to 36, the microscopic structure was an acicular structure, and the width of the acicular α phase was 5 μm or less, and, thus, both the microscopic structure and the width fell within the scope of the present invention. For each of test Nos. 31 to 36, the tensile strength was 985 MPa or more and the impact value was 30 J/cm$^2$ or more.

For each of test Nos. 37, 38, and 39, the microscopic structure was an acicular structure. However, the width of the acicular α phase was above the scope of the present invention, and the strength and the impact value were unsatisfactory.

Experiment Example 4

As described above, for example, Ti-6Al-4V is known as an α+β titanium alloy member. Even in conventional a-EP titanium alloy members, an acicular microscopic structure, that is, an acicular α phase, can be obtained by heat treatment at or above the 13 transformation temperature. However, when an acicular α phase is formed in conventional α+β titanium alloy members, high strength and high toughness could not be simultaneously satisfied. In order to demonstrate this, the inventors of the present invention carried out Experiment Example 4 (present invention).

In Experiment Example 4, round rods (parent metal) each having a diameter of 15 mm and having a composition of Ti-6.3Al-4.2V-0.180 were provided in the same treatment used in Experiment Example 1. The β transformation temperature of the parent metal was 980° C. Subsequently, the parent metal was subjected to solution treatment in which the parent metal was held at a temperature of 1050° C. for 15 to 25 minutes followed by air cooling to prepare a titanium alloy member of test No. 40. The parent metal was subjected to solution treatment in which the parent metal was held for 60 minutes at a temperature of 870° C. that was below the β transformation temperature followed by water cooling, thereby preparing a titanium alloy member of test No. 41. Further, the parent metal was subjected to solution treatment in which the parent metal was held at 1050° C. for 15 to 25 minutes followed by water cooling, thereby preparing a titanium alloy member of test No. 42. Subsequently, for each of the titanium alloy members of test Nos. 40 to 42, the tensile strength and the toughness were evaluated in the same manner as in Experiment Example 1. The results of evaluation are shown in Table 5.

TABLE 5

| Test No. | Micro-scopic structure | Width of α phase (μm) | Tensile strength (MPa) | Impact value (J/cm$^2$) | Remarks |
|---|---|---|---|---|---|
| 40 | Acicular | 2.3 | 971 | 32 | Comparative Example |
| 41 | Equiaxial | — | 1067 | 28 | Comparative Example |
| 42 | Acicular | 0.7 | 1118 | 16 | Comparative Example |

Experiment Example 4 demonstrates that, in conventional titanium alloy members, even when the width (average width) of the acicular α phase is less than 5 μm, high strength and high toughness cannot be simultaneously satisfied.

Preferred embodiments of the present invention have been described in detail in conjunction with the accompanying drawings. However, it should be noted that the present invention is not limited to such embodiments. Various alterations and modifications will become apparent to a person with ordinary skill in the art to which the invention pertains within the technical idea described in the claims, and it is understood that these of course belong to the technical scope of the present invention.

REFERENCE SIGNS LIST

A: colony

B: straight line

C: acicular α phase

The invention claimed is:

1. A titanium alloy member consisting of, in mass %,
Al: more than or equal to 4.5% and less than 5.5%,
Fe: more than or equal to 1.3% and less than 2.3%,
Si: more than or equal to 0.25% and less than 0.50%,
O: more than or equal to 0.05% and less than 0.25%, and
the balance: titanium and unavoidable impurities,
wherein the titanium alloy member has a microscopic structure that is an acicular structure having an acicular α phase with a mean width of less than 5 μm.

2. The titanium alloy member according to claim 1, wherein the acicular α phase has a mean width of less than 2 μm.

3. A method for manufacturing the titanium alloy according to claim 1, the method comprising:
molding an ingot into a parent metal member, the ingot consisting of, in mass%,
Al: more than or equal to 4.5% and less than 5.5%,
Fe: more than or equal to 1.3% and less than 2.3%,
Si: more than or equal to 0.25% and less than 0.50%,
O: more than or equal to 0.05% and less than 0.25%, and
the balance: titanium and unavoidable impurities; and
subjecting the parent metal member to heat treatment involving holding the parent metal member at or above a β transformation temperature for five minutes or longer and cooling the parent metal member at a rate of air cooling or more.

4. The method for manufacturing a titanium alloy member according to claim 3, wherein the cooling in the heat treatment step is water cooling.

* * * * *